US007649517B2

(12) United States Patent
Li et al.

(10) Patent No.: US 7,649,517 B2
(45) Date of Patent: Jan. 19, 2010

(54) DISPLAY

(75) Inventors: Chung-Lung Li, Taipei (TW); Shu-I Huang, Taipei (TW)

(73) Assignee: AU Optronics Corp., Hsin-Chu (TW)

( * ) Notice: Subject to any disclaimer, the term of this patent is extended or adjusted under 35 U.S.C. 154(b) by 626 days.

(21) Appl. No.: 11/353,525

(22) Filed: Feb. 14, 2006

(65) Prior Publication Data

US 2007/0008267 A1 Jan. 11, 2007

(30) Foreign Application Priority Data

Jul. 11, 2005 (TW) ..... 94123401 A

(51) Int. Cl.
*G09G 3/36* (2006.01)

(52) U.S. Cl. ..... 345/92

(58) Field of Classification Search ..... 345/87–92
See application file for complete search history.

(56) References Cited

U.S. PATENT DOCUMENTS 4,787,712 A * 11/1988 Ukai et al. ..... 349/38
5,286,983 A 2/1994 Sakamoto et al.
2004/0000668 A1* 1/2004 Yu ..... 257/72
2004/0145581 A1* 7/2004 Morita ..... 345/204

FOREIGN PATENT DOCUMENTS

TW 550822 9/2003

* cited by examiner

*Primary Examiner*—Richard Hjerpe
*Assistant Examiner*—Carolyn R Edwards
(74) *Attorney, Agent, or Firm*—Thomas, Kayden, Horstemeyer & Risley

(57) ABSTRACT

A liquid crystal display and a liquid crystal display panel thereof. Gates on thin film transistors serving as switches in the same row of pixels are coupled with a gate line. A scan signal is substantially inputted to a middle of the gate line and transmitted to two extremities of the gate line, so that the two thin film transistors, which are coupled with the two extremities of the gate line have substantially the same time for turning on/off. Namely, the pulse waveforms of scan signals received by the two pixels, which are spaced apart by a longest distance, are substantially the same.

3 Claims, 3 Drawing Sheets

DISPLAY

This application claims the benefit of Taiwan application Serial No. 94123401, filed Jul. 11, 2005, the subject matter of which is incorporated herein by reference.

BACKGROUND OF THE INVENTION

1. Field of the Invention

The invention relates in general to a liquid crystal display, and more particularly to a disposed structure of a scan line.

2. Description of the Related Art

FIG. 1 is a schematic illustration showing a pixel circuit. Referring to FIG. 1, a pixel 100 includes a thin film transistor TFT, a liquid crystal capacitor CL and a storage capacitor CS. The thin film transistor TFT has a gate G coupled with a scan line SL, a source S coupled with a data line DL, and a drain D coupled with the liquid crystal capacitor CL and the storage capacitor CS. The liquid crystal capacitor CL and the storage capacitor CS store charges for driving liquid crystal molecules.

FIG. 2 is a schematic illustration showing the structure of a conventional liquid crystal display. Referring to FIG. 2, a liquid crystal display 102 includes a scan driver circuit 104, a data driver circuit 106 and a pixel array 108 composed of a plurality of pixels 100. When the liquid crystal display 102 displays frames, the scan driver circuit 104 sequentially outputs N scan signals SS to the corresponding scan line SL so as to turn on the transistors TFT in each row of pixels of the pixel array 108, and the data driver circuit 106 sequentially inputs corresponding pixel voltages VP from the corresponding data lines DL(1) to DL(M) to each row of pixels 100, wherein N and M are positive integers. The pulse waveform of the scan signal SS approximates a square wave and has a voltage level for turning on the transistor TFT.

Because each pixel 100 has the capacitors CL and CS and a capacitor effect exists between the scan line SL and other plates, each scan line SL may be regarded as having the resistor-capacitor (RC) effect. Thus, after the scan signal SS passes through a row of pixels, the square wave of the scan signal SS may have distortion, which is the so-called gate-delay, due to the RC effect in the circuit.

Taking the first row R(1) of pixels as an example, the scan signal SS is inputted to the first row R(1) of pixels through the scan line SL(1), i.e., inputted to the first pixel 100 from the node L of FIG. 2. The scan signal SS is gradually distorted with the increase of the transmission distance on the scan line SL(1). When the signal reaches the rightmost end (i.e., node R of FIG. 2) of the first row R(1) of pixels, the generated distortion is most serious. Because the distorted scan signal SS shortens the time period during which the TFT of the pixel 100 turns on, the time periods during which the pixels at the rightmost and leftmost pixels 100 are different, and the corresponding liquid crystal capacitor CL and the storage capacitor CS have insufficient time periods to store the predetermined charges, such that the predetermined luminance cannot be generated.

Thus, when the same pixel data is to be displayed on the whole frame, the pixels receive the same pixel voltage VP but the luminance at the right-hand side and the luminance at the left-hand side of the frame are not the same. For example, the pixel closest to the node to which the scan signal SS is inputted is the brightest, and the pixel farthest from the node to which the scan signal SS is inputted is the darkest. Thus, the luminance of the overall frame looks very nonuniform, and the image quality is influenced.

SUMMARY OF THE INVENTION

It is therefore an object of the invention to provide a liquid crystal display and a liquid crystal display panel thereof capable of solving the nonuniform luminance of a frame caused by a waveform distortion of a scan signal, so that the image quality of the liquid crystal display may be improved.

The invention achieves the above-identified object by providing a pixel array of a liquid crystal display. The liquid crystal display has a scan driver circuit for outputting a scan signal. The pixel array includes a first row of pixels, a gate line and a scan line. The first row of pixels has a plurality of first pixels, each of which has a thin film transistor. The gate line is electrically connected to gates of the thin film transistors and has an electrical contact disposed between two extremities of the gate line. The scan line has one extremity coupled with the scan driver circuit to receive the scan signal, and the other extremity coupled with the electrical contact to transmit the scan signal to the gate line.

The invention also achieves the above-identified object by providing a liquid crystal display including a scan driver circuit and a liquid crystal display panel. The scan driver circuit outputs a scan signal. The liquid crystal display panel includes a first row of pixels, a gate line and a scan line. The first row of pixels has a plurality of first pixels, each of which has a thin film transistor. The gate line is electrically connected to gates of the thin film transistors and has an electrical contact disposed between two extremities of the gate line. The scan line has one extremity coupled with the scan driver circuit to receive the scan signal, and the other extremity coupled with the electrical contact to transmit the scan signal to the gate line in order to turn on the thin film transistor.

Other objects, features, and advantages of the invention will become apparent from the following detailed description of the preferred but non-limiting embodiment. The following description is made with reference to the accompanying drawings.

DETAILED DESCRIPTION OF THE INVENTION

The invention provides a liquid crystal display and a liquid crystal display panel thereof. In the same row of pixels, gates of thin film transistors for serving as switch are coupled with a gate line, and a scan signal is substantially inputted from a middle of the gate line and transmitted to two extremities of the gate line, such that the thin film transistors close to the two extremities of the gate line have almost the same time for turning on/off. That is, the pulse waveforms of the scan signal received by two pixels, which are farthest from each other in the same row of pixels, are almost the same. Finally, the frame luminance of the liquid crystal display becomes more uniform, and the better image quality is thus obtained.

Figure 1:
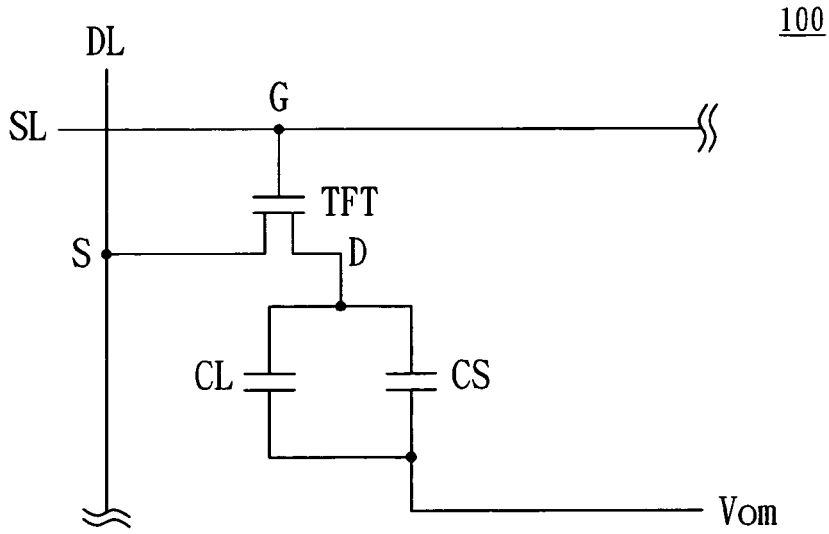
FIG. 1(RELATED ART)
FIG. 1 is a schematic illustration showing a pixel circuit.
Figure 2:
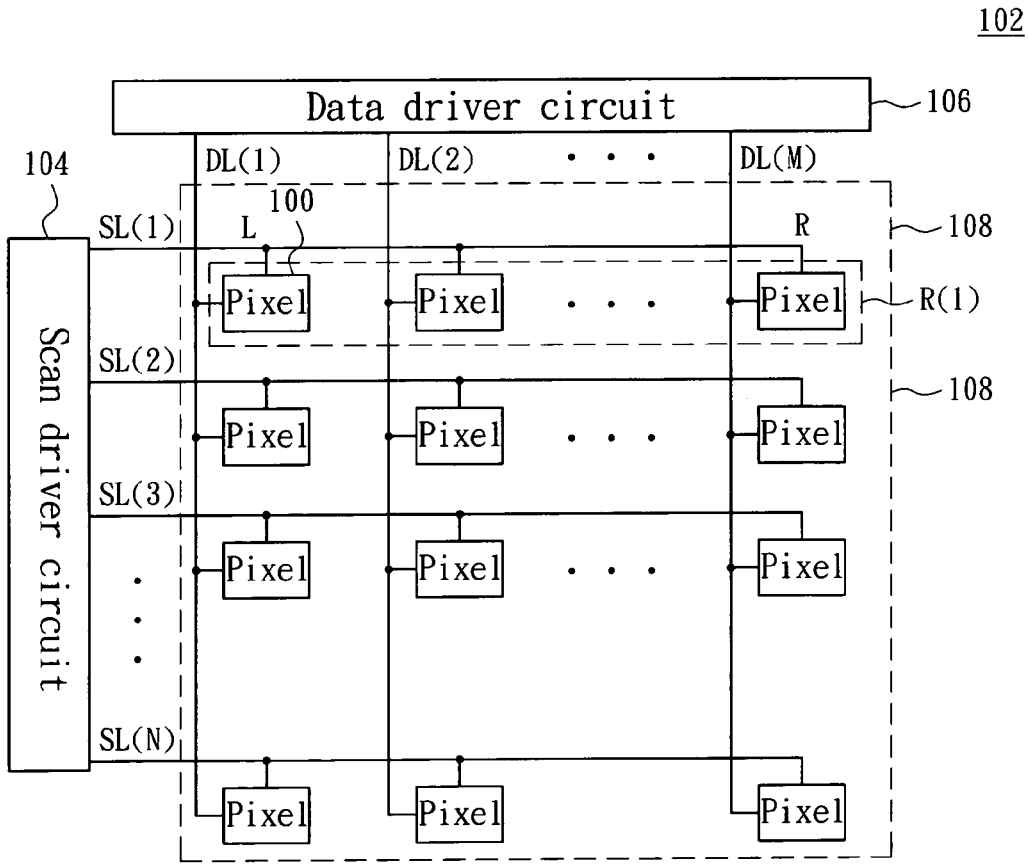
FIG. 2(RELATED ART)
FIG. 2 is a schematic illustration showing the structure of a conventional liquid crystal display.
Figure 3:
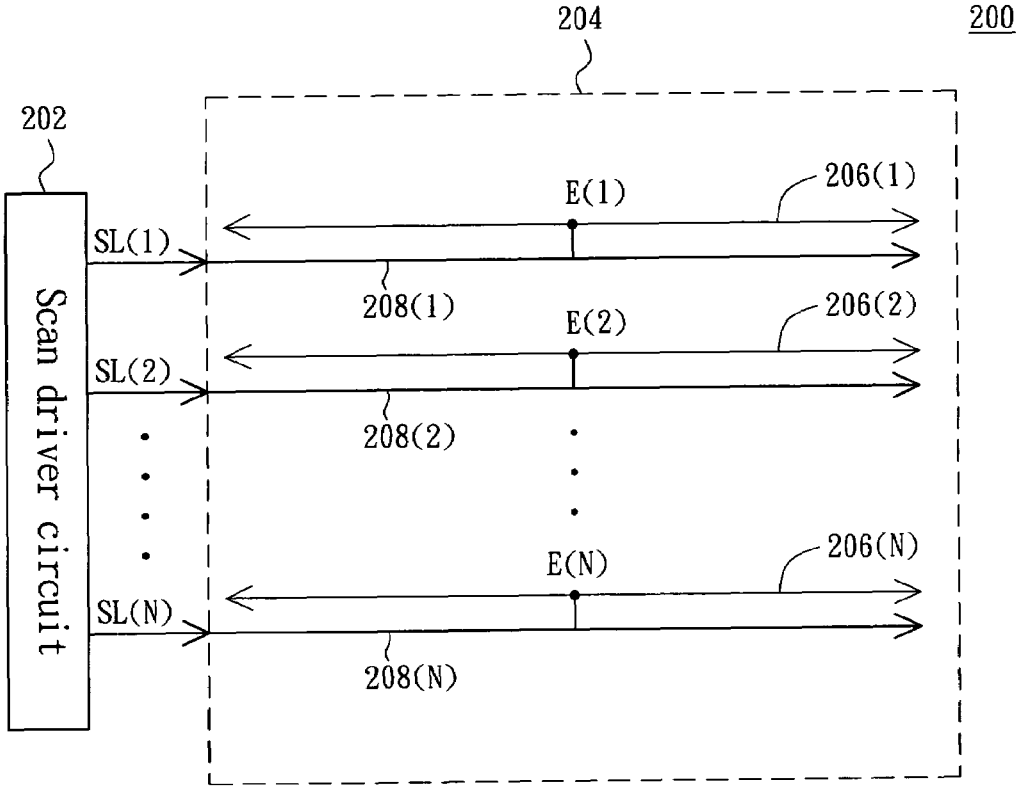
FIG. 3 is a schematic illustration showing a liquid crystal display of the invention.

FIG. 3 is a schematic illustration showing a liquid crystal display of the invention. Referring to FIG. 3, a liquid crystal display 200 includes a scan driver circuit 202 and a pixel array 204. The scan driver circuit 202 sequentially outputs a scan signal SL to each scan line 208. The pixel array 204 includes N gate lines 206(1) to 206(N) and corresponding N scan lines 208(1) to 208(N), wherein N is a positive integer. The gate line 206 and the scan line 208 transmit the scan signal SL to the corresponding pixel P (pixel P is not shown in FIG. 3). In these pixels P, the gates in the thin film transistors serving as switches are coupled with the corresponding gate line 206 to receive the scan signal SL for turning on the transistors.

Taking the first scan line 208(1) and the first gate line 206(1) as an example, the thin film transistors serving as switches in the first row of pixels have the gates electrically connected to the gate line 206(1) and a corresponding electrical contact E(1). One extremity of the scan line 208(1) is coupled with the scan driver circuit 202 to receive the scan signal SL. The other extremity of scan line 208(1) is coupled with the electrical contact E(1) to transmit the scan signal SL to the gate line 206(1). Preferably, each of the electrical contacts E(1) to E(N) are located at a middle position between two extremities of the corresponding gate lines 206(1) to 206(N).

The scan signal SL is inputted to the middle of the gate line 206(1) and transmitted to two extremities of the gate line 206(1). Because the transmission distances from the middle to the two extremities are the same, the scan signals SL transmitted from the middle to the two extremities encounter almost the same RC (Resistance Capacitance) effect. So, waveform distortions of the scan signals SL are almost the same. That is, the pulse waveforms of the scan signals SL received by the pixels P at the two extremities are almost the same, so the pixels at the two extremities almost have the same time for turning on.

The scan signal SL is inputted to the middle of the gate line 206(1) after it passes through the scan line 208(1). However, a waveform distortion of the scan signal SL has been generated when the scan signal SL is transmitted on the scan line 208(1). Because the RC effect caused by the scan line 208(1) has filtered out the high-frequency component of the scan signal SL, the high-frequency component of the scan signal SL that can be filtered out by the RC effect of the gate line 206(1) during the transmission of the scan signal SL toward the two extremities of the gate line 206(1) will be greatly reduced. Finally, compared to the prior art, the waveforms of the scan signals SL received by the pixels P coupled with the gate line 206(1) approximate one another. That is, the pixels P have almost the same charging time such that the luminance of the frame displayed on the liquid crystal display 200 becomes more uniform. The invention will be described in detail according to the preferred embodiment.

Figure 4:
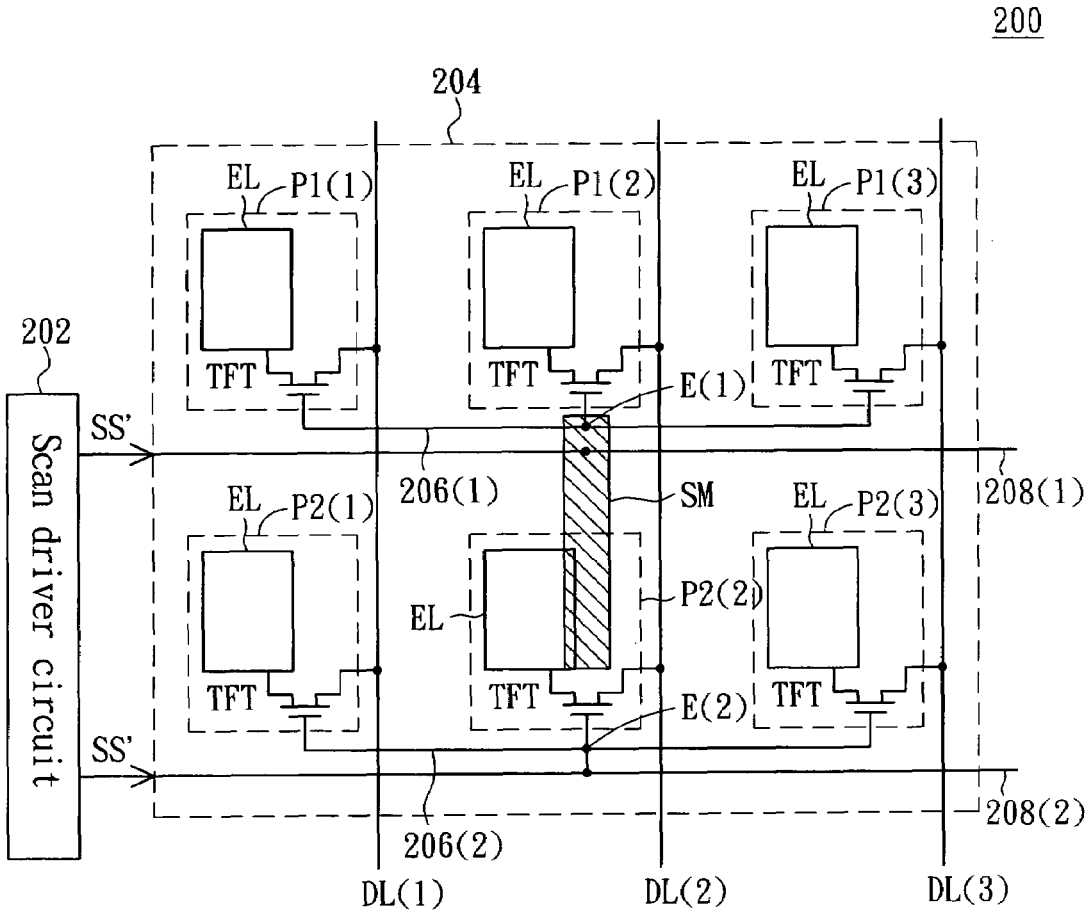
FIG. 4 is a schematic illustration showing the architecture of the liquid crystal display according to a preferred embodiment of the invention.

FIG. 4 is a schematic illustration showing the architecture of the liquid crystal display according to a preferred embodiment of the invention. Referring to FIG. 4, the pixel array 204 further includes multiple pixels P arranged in M rows, wherein M is a positive integer. In the example of FIG. 4, two rows of pixels each having 3 pixels P are illustrated as an example. The first row of pixels has 3 first pixels P1(1) to P1(3). Each of the first pixels P1(1) to P1(3) respectively has a thin film transistor TFT serving as a switch. The gate line 206(1) is electrically connected to the gates of the thin film transistors TFT of the first pixels P1(1) to P1(3) and has an electrical contact E(1) disposed between two extremities of the gate line 206(1). As mentioned hereinabove, the electrical contact E(1) is disposed at the middle of the gate line 206(1).

The scan line 208(1) has one extremity coupled with the scan driver circuit 202 to receive the corresponding scan signal SL, and the other extremity coupled with the electrical contact E(1) of the gate line 206(1) to transmit the scan signal SL to the gate line 206(1). The second row of pixels also has 3 second pixels P2(1) to P2(3), and the structure thereof is the same as that described hereinabove. So, detailed descriptions thereof will be omitted. In addition, the thin film transistor TFT of each of the first pixels P1(1) to P1(3) and the second pixels P2(1) to P2(3) has one extremity coupled with the corresponding one of the data lines DL(1) to DL(3), and the other extremity coupled with the corresponding pixel electrode EL.

As for the electrical connection between the first gate line 206(1) and the first scan line 208(1), each of the pixels P (including the first pixel P1 and the second pixel P2) has a pixel electrode EL. When the pixel electrodes EL are disposed on a glass substrate, a gap exists between the pixel electrodes EL. Liquid crystal molecules in this gap is free from being controlled by an electric field between the pixel electrode EL and a common electrode, so the region has to be shielded to avoid the light-leakage. For example, a metallurgy layer SM, such as a shield metal, is formed to shield the region between the pixel electrodes of the pixels P2(2) and P2(3). The electrical contact E(1) of the gate line 206(1) is connected to the scan line 208(1) using the shield metal SM to bridge the electrical contact E(1) and the scan line 208(1). That is, extending the shield metal SM enables the electrical contact E(1) to be connected to the corresponding scan line 208(1) through the shield metal SM serving as a wire. Thus, the gate line 206(1) may be electrically connected to the scan line 208(1) in the vicinity of the middle of the gate line 206(1) without influencing the aperture ratio.

It is to be noted that the electrical connection between the gate line 206 and the scan line 208 of this embodiment of the invention is not particularly limited. Instead, any method of electrically connecting the gate line 206 to the scan line 208 in the vicinity of the middle position of the gate line 206 may be adopted such that the scan signal SL can be inputted to the gate line 206 from the middle position of the gate line 206. Also, the position of the electrical connection between the gate line 206 and the scan line 208 is not particularly restricted at the middle of the gate line 206. Instead, any position close to the middle of the gate line 206 may be chosen as the position for the electrical connection.

In addition, each pixel P has a storage capacitor (not shown in FIG. 4) for storing charges for driving the liquid crystal molecules. In the condition when the one end of the storage capacitance is coupled with the scan line for the adjacent row of pixels, the first scan line 208(1) and the first gate line 206(1) will be described as an example. One end of the scan line 208(1) is electrically connected to the scan driver circuit 202 to receive the scan signal SL, and the other end of the scan line 208(1) is then electrically connected to the gate line 206(1) through the shield metal SM after the other end of the scan line 208(1) enters the display region and arrives at the middle of the panel. However, after the other end of the scan line 208(1) is electrically connected to the gate line 206(1), the other end of the scan line 208(1) continuously extends to the boundary of the display region. As shown in FIG. 3, the scan line 208 extends to the two extremities of the display region. Thus, the scan line 208 can serve as a storage capacitance of the adjacent row of pixels, such as the second pixels P2(1) to P2(N) of the second row of pixels of FIG. 4, and the gate line 206(1) may also serve as a storage capacitor of the second pixels P2(1) to P2(N) of the second row of pixels. So, the scan line 208(1) and the gate line 206(1) can increase the total capacity of the storage capacitance of the pixels P2(1) to P2(3) in the second row of pixels. The increase of the total capacity of the storage capacitor can improve the display quality of the liquid crystal display, such as flicker, mura, or the like.

The liquid crystal display and its liquid crystal display panel according to the embodiment of the invention enable the scan signal to be inputted at or in the vicinity of the middle of the gate line and to be transmitted to two extremities of the gate line, such that the thin film transistors close to the two extremities of the gate line have substantially the same time for turning on/off. Finally, the luminance of the frame displayed on the liquid crystal display becomes more uniform. The extension of the shield metal enables the gate line to be electrically connected to the scan line without influencing the aperture ratio of the pixel. In addition, the scan line and the gate line may serve as the storage capacitor for the adjacent row of pixels, and the display quality of the liquid crystal display may be improved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display, comprising:

a scan driver circuit for outputting a scan signal;

a plurality of thin film transistors, each thin film transistor having a gate;

a first row of pixels, each of the pixels coupled to at least one of the thin film transistors;

a gate line coupled to the gates of the thin film transistors and having an electrical contact between two ends of the gate line; and a scan line coupled to the scan driver circuit for receiving the scan signal and connected to the electrical contact for transmitting the scan signal to the gate line.

2. The display according to claim 1, wherein the electrical contact is located near a middle position of the two ends of the gate line.

3. The display according to claim 1, further comprising:

a second row of pixels, each of the second row of pixels having a corresponding shield metal, wherein the scan line is electrically connected to the electrical contact through the shield metal of the second row of pixels closest to the electrical contact.

* * * * *